US007543919B2

(12) United States Patent
Sugahara

(10) Patent No.: US 7,543,919 B2
(45) Date of Patent: Jun. 9, 2009

(54) LIQUID TRANSPORT APPARATUS AND METHOD FOR PRODUCING THE SAME

(75) Inventor: Hiroto Sugahara, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 387 days.

(21) Appl. No.: 11/213,839

(22) Filed: Aug. 30, 2005

(65) Prior Publication Data

US 2006/0044360 A1 Mar. 2, 2006

(30) Foreign Application Priority Data

Aug. 31, 2004 (JP) ..... 2004-251682

(51) Int. Cl.
*B41J 2/045* (2006.01)

(52) U.S. Cl. ..... 347/71

(58) Field of Classification Search ..... 347/68–72
See application file for complete search history.

(56) References Cited

FOREIGN PATENT DOCUMENTS

| | | | |
|---|---|---|---|
| EP | 1 403 063 A1 | | 3/2004 |
| JP | 58-56870 | | 4/1983 |
| JP | 1297252 | | 11/1989 |
| JP | 5162311 | | 6/1993 |
| JP | 2727196 | | 12/1997 |
| JP | 2000-33699 | | 2/2000 |
| JP | 2004-9344 | | 1/2004 |
| JP | 2004-009344 | * | 1/2004 |
| WO | WO88/10192 | | 12/1988 |
| WO | WO 88/10192 | * | 12/1998 |

OTHER PUBLICATIONS

European Search Report from European Application No. 05018850.7 mailed Sep. 29, 2006.

* cited by examiner

*Primary Examiner*—Stephen D Meier
*Assistant Examiner*—Geoffrey Mruk
(74) *Attorney, Agent, or Firm*—Banner & Witcoff, Ltd

(57) ABSTRACT

A liquid transport apparatus includes an actuator and a flow passage unit having discharge ports. The flow passage unit is formed by stacking plates. Flow passage-forming holes, which are formed through the respective plates, are communicated with each other to form a flow passage. The respective plates have mainstream areas in which the through-holes of all of the plates are overlapped, and branch areas in which the adjoining through-holes are overlapped. The branch areas are arranged in a spiral form directed toward the discharge ports. Therefore, a vortex flow of the liquid is generated, and the bubbles, which stay in the flow passages, are reliably discharged.

12 Claims, 15 Drawing Sheets

LIQUID TRANSPORT APPARATUS AND METHOD FOR PRODUCING THE SAME

BACKGROUND OF THE INVENTION

1. Field of the Invention

The present invention relates to a liquid transport apparatus for transporting a liquid and a method for producing the same.

2. Description of the Related Art

A variety of liquid transport apparatuses capable of transporting liquids have been hitherto known. In particular, an ink-jet head is known, in which the ink is transported to nozzles to discharge the ink from the nozzles to the printing paper or the like. The ink-jet head includes a flow passage unit which is provided with a plurality of ink flow passages including pressure chambers communicated with nozzles, and an actuator unit which applies the pressure to the ink contained in the pressure chambers. The ink-jet head is constructed such that the pressure is selectively applied to the ink contained in the plurality of pressure chambers, and thus the ink is discharged from the nozzles communicated with the pressure chambers.

In the case of the ink-jet head as described above, when the ink flow passage is contaminated with bubbles coming from the outside, and the bubbles remain in the ink flow passage, then it is impossible to reliably apply the pressure to the ink contained in the pressure chamber (in the ink flow passage) by using the actuator unit. Therefore, the ink-jet head is generally constructed so that the purge operation can be executed to forcibly discharge the bubbles together with the ink from the nozzle. However, even when the purge operation is performed, it is difficult to discharge the bubbles adhered to the portion disposed in the vicinity of the wall surface of the ink flow passage, because the flow velocity of the ink is low in the vicinity of the wall surface. Therefore, in order to completely discharge the bubbles contained in the ink flow passage, it is necessary to repeatedly execute the purge operation many times. As a result, the ink is consumed uselessly in many cases. In view of the above, an ink-jet head has been suggested, which is constructed to enhance the flow velocity of the ink in the vicinity of the wall surface so that the bubbles can be discharged more reliably by generating a vortex flow in the ink flow passage.

For example, an ink-jet head described in Japanese Patent Application Laid-open No. 5-162311 is constructed such that an ink supply passage, which supplies the ink to a pressure chamber, is arranged on a tangential line of a side wall of the pressure chamber, and a vortex flow is generated in the pressure chamber when the ink inflows into the pressure chamber. On the other hand, an ink-jet head described in Japanese Patent Application Laid-open No. 1-297252 is constructed such that a spiral hole is formed in a filter provided at a halfway portion of an ink flow passage, and a vortex flow is generated in the ink flow passage by the aid of the hole.

In the case of the ink-jet head described in Japanese Patent Application Laid-open No. 5-162311, the bubbles, which remain in the pressure chamber, tend to be discharged with ease, because the vortex flow is formed in the pressure chamber. However, in reality, the ink flow passage, which is formed in the flow passage unit, includes many bent portions and many portions in which the flow passage area is increased/decreased, for example, at circumferential portions of the nozzle at which the flow passage area is suddenly decreased. The bubbles tend to remain especially easily at the corners which are formed at the portions as described above. However, it is difficult to completely discharge the bubbles remaining at the halfway portions of the ink flow passage as described above by only the vortex flow generated in the pressure chamber. On the other hand, in the case of the ink-jet head described in Japanese Patent Application Laid-open No. 1-297252, the bubbles, which partially remain around the filter, can be discharged owing to the action of the vortex flow generated by the spiral hole formed for the filter. However, in order to completely discharge the bubbles remaining in the ink flow passage, it is necessary that the filters each having the spiral hole should be provided at several portions of the ink flow passage. The flow passage resistance is increased as well, and this arrangement is also disadvantageous in view of the production cost.

In order to produce the ink flow passage of the ink-jet head, it is advantageous for the production to form the ink flow passage by stacking a plurality of plates. In such a procedure, ink flow holes, which reach the nozzle, are communicated with each other by forming the ink flow holes through the respective plates and stacking the plates. However, when the flow passage is formed by stacking the plates as described above, any stepped portion (or any corner portion) is formed between the adjoining plates in some cases. Bubbles tend to stay with ease at the stepped portion as described above. Even when the holes of the respective plates are designed to be identical in order to form the smooth flow passage, the hole positions are sometimes deviated by several micrometers to several tens micrometers between the adjoining plates when the plates are stacked. The positional deviation as described above causes the stepped portion between the adjoining plates. Therefore, the problem of the remaining bubbles is especially serious in the case of the ink-jet head of the type in which the flow passage is formed by stacking the plates (stacked type head).

SUMMARY OF THE INVENTION

An object of the present invention is to provide a liquid transport apparatus having a flow passage unit of the stacked type which makes it possible to reliably discharge bubbles contained in a liquid flow passage by generating a vortex flow in the liquid flow passage with a simple construction.

According to a first aspect of the present invention, there is provided a liquid transport apparatus comprising a flow passage unit which has a liquid flow passage; and a transport force-applying mechanism which applies a transport force to a liquid contained in the liquid flow passage; wherein the flow passage unit includes a plurality of stacked plates which are formed with a plurality of flow passage-forming holes respectively for constructing at least a part of the liquid flow passage; mainstream areas and branch areas (sidestream areas) are formed in the plurality of flow passage-forming holes respectively, the mainstream areas being substantially overlapped with each other as viewed in a direction perpendicular to the plates, and the branch areas being disposed outwardly as compared with the mainstream areas as viewed in the direction perpendicular to the plates; and the branch areas are provided so that adjacent branch areas, which are adjacent to each other in a stacking direction of the plates, are partially overlapped with each other as viewed in the direction perpendicular to the plates, and the branch areas are formed in a spiral form.

In the liquid transport apparatus, the liquid is transported by the transport force-applying mechanism along the liquid flow passage of the flow passage unit to a predetermined position. The flow passage unit includes the plurality of plates which are in the stacked state. The plurality of flow passage-forming holes, which constitute at least a part of the liquid flow passage, are formed through the plurality of plates respectively. The mainstream areas through which the mainstream of the liquid flows and the branch areas disposed outwardly as compared with the mainstream areas are formed in the plurality of flow passage-forming holes respectively. In this application, the term "mainstream areas" refers to the areas which are substantially overlapped with each other as viewed in the direction perpendicular to the plates, in the flow passage-forming holes formed through the respective plates. It is considered that the mainstream of the flow of the liquid smoothly flows through the flow passage defined by the mainstream areas. On the other hand, the term "branch areas" refers to the areas other than the mainstream areas in the flow passage-forming holes formed through the respective plates. In the present invention, the plurality of branch areas are arranged in the spiral form while being partially overlapped with each other. Therefore, it is considered that the branch of the liquid flowing through the plurality of branch areas forms the vortex flow. Accordingly, the flow velocity of the liquid is increased in the vicinity of the wall surface of the liquid flow passage, and it is possible to reliably discharge the bubbles staying in the vicinity of the wall surface. Further, it is unnecessary to perform the operation for discharging the bubbles (purge operation) many times in order to discharge the bubbles. It is possible to decrease the amount of the liquid discharged during the purge operation, and it is possible to use the liquid more efficiently. Further, the vortex flow can be reliably generated in the liquid flow passage by the simple structure including only the plurality of flow passage-forming holes formed at the predetermined positions of the plurality of plates respectively, which is advantageous in view of the production cost. It is unnecessary that the mainstream areas and the branch areas are present in the flow passage-forming holes of all of the plates for constructing the flow passage unit. It is enough that the mainstream areas and the branch areas are present in the flow passage-forming holes of only several plates of the plurality of plates for constructing the flow passage unit. For example, even when a flow passage unit is formed by a cavity plate, a base plate, a plurality of manifold plates, and a nozzle plate as in an embodiment described later on, the mainstream areas and the branch areas may exist in only the cavity plate, the base plate, and some of the manifold plates.

In the liquid transport apparatus of the present invention, a plurality of the branch areas may be formed in one of the flow passage-forming holes. In this arrangement, a plurality of vortex flows flowing through the plurality of branch areas are generated. Therefore, it is possible to discharge the bubbles staying in the liquid flow passage more reliably.

In the liquid transport apparatus of the present invention, the branch areas, which are formed in one of the flow passage-forming holes, may be arranged at equal angular intervals in a circumferential direction to depict the spiral form. The vortex flows, which are generated in the plurality of branch areas, flow uniformly in the circumferential direction, because the plurality of branch areas are arranged at the equal angular intervals as described above. It is possible to reliably discharge the bubbles staying in the liquid flow passage.

In the liquid transport apparatus of the present invention, the mainstream areas and the branch areas may be connected to one another in the flow passage-forming holes. In this arrangement, the liquid flows more smoothly, because the mainstream and the branch of the liquid are not separated from each other.

In the liquid transport apparatus of the present invention, the flow passage-forming holes may be formed to have an elliptical shape which is long in a certain direction. Therefore, the vortex flow can be reliably generated in the liquid flow passage by the flow passage-forming holes each having the simple shape. Further, it is possible to form the flow passage-forming holes with ease.

In the liquid transport apparatus of the present invention, center lines of the mainstream areas may be coincident with each other. In this arrangement, the mainstream flows more smoothly.

In the liquid transport apparatus of the present invention, the branch areas may be positioned while being deviated from each other by equal angles in a circumferential direction to depict the spiral form between adjoining plates. In this arrangement, the flow passage resistance is uniform in relation to the flow direction of the liquid. Therefore, the mainstream and the branch as the vortex flow are allowed to flow stably.

In the liquid transport apparatus of the present invention, the liquid flow passage may include a nozzle which discharges the liquid to outside of the flow passage unit; and the plurality of flow passage-forming holes may define the liquid flow passage in the vicinity of the nozzle. The bubbles tend to stay especially easily in the vicinity of the nozzle, because the flow passage area is suddenly decreased in the liquid flow passage. However, the vortex flow is generated at such a portion, and thus it is possible to reliably discharge the bubbles.

In the liquid transport apparatus of the present invention, the transport force-applying mechanism may be an actuator unit. In this arrangement, the transport force can be applied to the liquid by the simple construction.

According to a second aspect of the present invention, there is provided a liquid transport apparatus comprising a flow passage unit which includes a stack formed by stacking a plurality of plates formed with through-holes respectively so that the through-holes are arranged on a predetermined axis to define a flow passage and which has a liquid discharge port communicated with the flow passage; and a transport force-applying mechanism which applies a transport force to a liquid contained in the flow passage; wherein outermost portions of walls for defining the through-holes of the plurality of plates, which are disposed farthest from the axis, are arranged so that a spiral is depicted about a center of the axis as positions of the outermost portions approach the liquid discharge port. In the liquid transport apparatus of the present invention, the outermost portions of the through-holes are arranged to depict the spiral. Therefore, the liquid flow in the spiral form is generated in the flow passage. It is possible to allow the bubbles generated in the flow passage unit having the stacked structure to flow out together with the liquid.

In the liquid transport apparatus of the present invention, the through-holes, which are formed through the plurality of plates, may be elliptical respectively, centers of ellipses may be positioned on the axis, and angles of rotation of the ellipses with respect to the axis may differ among the plurality of plates. Alternatively, the through-holes, which are formed through the plurality of plates, may be shaped to be in rotational symmetry, a center of the rotational symmetry may be positioned on the axis, and angles of rotation of the through-holes with respect to the axis may differ among the plurality of plates. The through-hole may include a plurality of holes.

In the liquid transport apparatus of the present invention, the through-holes of the respective plates may have mainstream areas which are overlapped in the through-holes of the plurality of plates, and branch areas which are overlapped only between adjoining plates.

The liquid transport apparatus of the present invention may further comprise another plate having a through-hole which is communicated with the liquid discharge port and which corresponds to only the mainstream areas. Alternatively, the liquid transport apparatus of the present invention may further comprise another plate which is formed with a nozzle hole, wherein the nozzle hole may be the liquid discharge port.

According to a third aspect of the present invention, there is provided a method for producing the liquid transport apparatus according to the second aspect of the present invention; the method comprising forming a flow passage unit by stacking a plurality of plates formed with through-holes respectively so that the through-holes are arranged on a predetermined axis to define a flow passage, and so that outermost portions of walls for defining the through-holes, which are disposed farthest from the axis, are arranged to depict a spiral about a center of the axis as positions of the outermost portions approach a liquid discharge port; and providing a transport force-applying mechanism which applies a transport force to a liquid contained in the flow passage. According to this production method, the bubbles hardly remain even when the liquid transport apparatus has the flow passage unit having the stacked structure, because the spiral liquid flow is generated in the flow passage.

In the production method of the present invention, the plurality of plates may include first to third plates which are formed with first to third through-holes having mutually identical shapes respectively, and angles of rotation of the first to third through-holes with respect to the axis may be different from each other. The plurality of plates may include first to third plates which are formed with first to third through-holes respectively, and a shape of the first through-hole may be different from a shape of the second through-hole. The method for producing the liquid transport apparatus may further comprise providing a pressure chamber between the flow passage unit and the transport force-applying mechanism.

BRIEF DESCRIPTION OF THE DRAWINGS

FIG. 6 (FIGS. 6A to 6F) shows plan views illustrating plates for constructing a flow passage unit, wherein

FIG. 9 (FIGS. 9A to 9F) shows plan views illustrating plates for constructing a flow passage unit according to a first modified embodiment, wherein

FIG. 12 (FIGS. 12A to 12F) shows plan views illustrating plates for constructing a flow passage unit according to a second modified embodiment, wherein

FIG. 14 (FIGS. 14A to 14F) shows plan views illustrating plates for constructing a flow passage unit according to a third modified embodiment, wherein

DESCRIPTION OF THE PREFERRED EMBODIMENTS

An embodiment of the present invention will be explained. This embodiment is illustrative of a case in which the present invention is applied to an ink-jet head for discharging the ink onto the recording paper.

Figure 1:
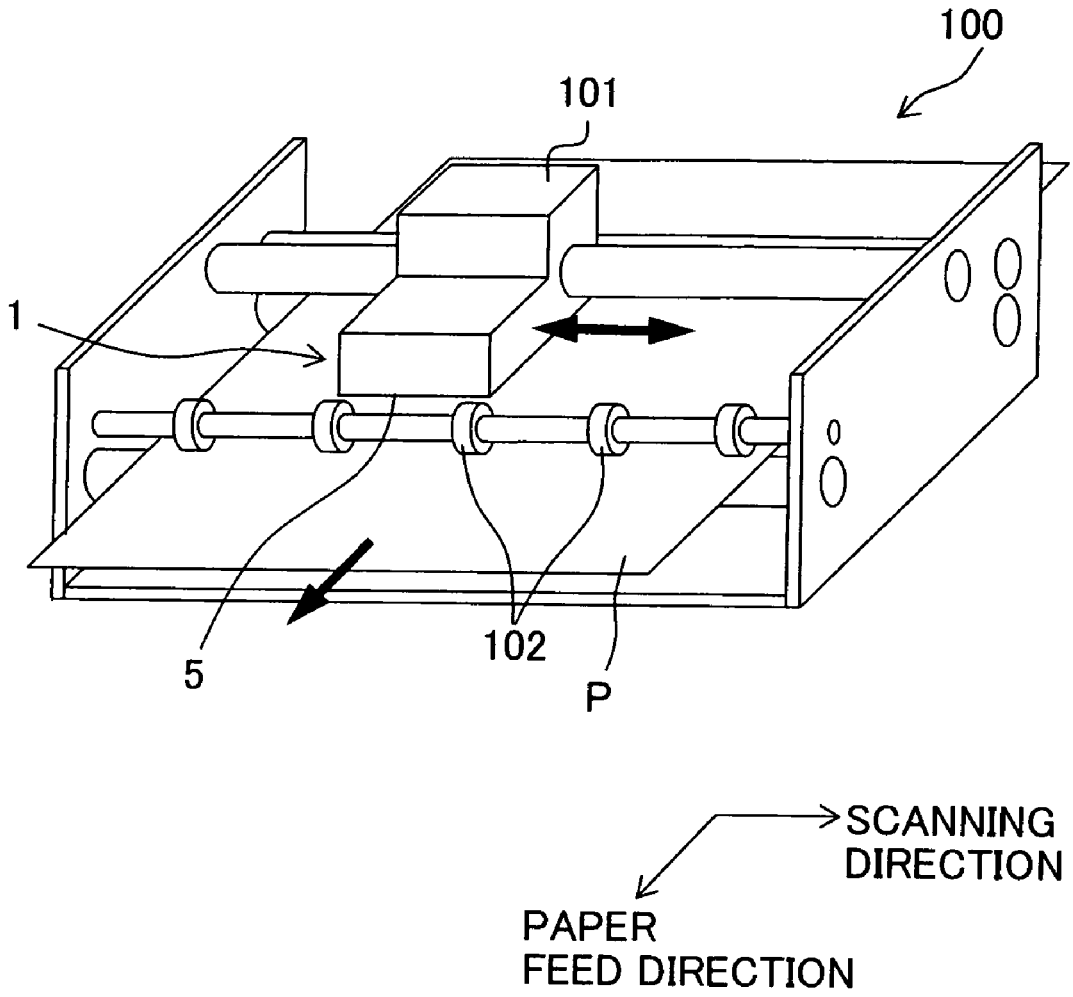
FIG. 1 shows a schematic perspective view illustrating an ink-jet printer according to an embodiment of the present invention.
Figure 2:
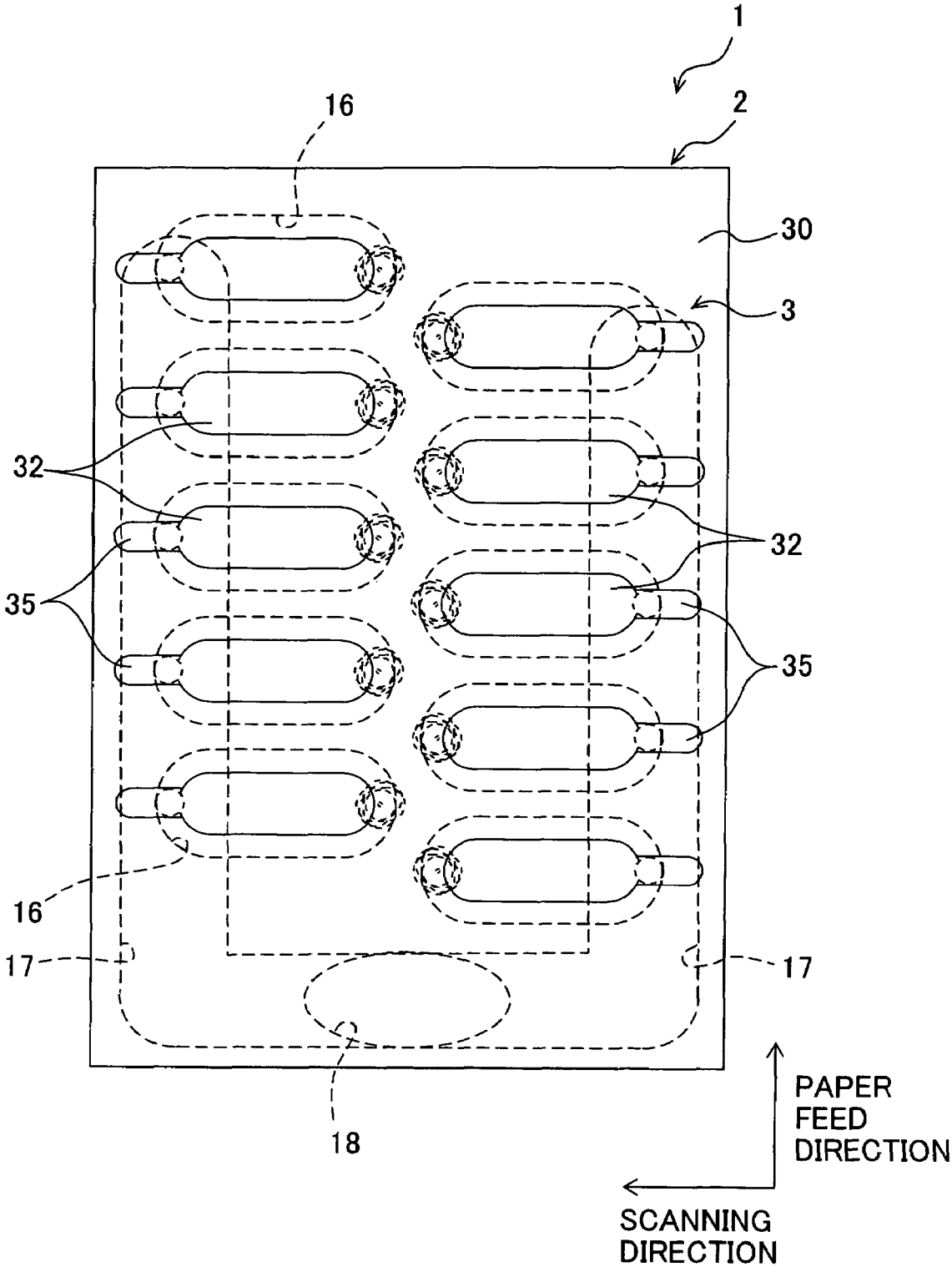
FIG. 2 shows a plan view illustrating an ink-jet head.

At first, an ink-jet printer 100 provided with an ink-jet head 1 will be briefly explained. As shown in FIG. 1, the ink-jet printer 100 includes, for example, a carriage 101 which is movable in the left and right directions as viewed in FIG. 1, the ink-jet head 1 of the serial type which is provided on the carriage 101 and which discharges the ink with respect to the recording paper P, and a transport roller 102 which transports the recording paper P frontwardly as viewed in FIG. 1. The ink-jet head 1 is moved in the left and right directions (scanning directions) integrally with the carriage 101 to discharge the ink to the recording paper P from the discharge ports of the nozzles 24 formed on an ink discharge surface 5 disposed at the lower surface of the ink-jet head 1. The recording paper P, which has been subjected to the recording by the ink-jet head 1, is discharged frontwardly (in the paper feed direction) by the transport rollers 102.

The ink-jet printer 100 further includes a purge mechanism including, for example, a purge cap 103 (see FIG. 8) which is detachably installed to the ink discharge surface 5 of the ink-jet head 1, and a purge pump (not shown) which is connected to the purge cap 103. The purge mechanism discharges the bubbles to the outside such that the bubbles, which entered into the ink flow passage in the ink-jet head 1, are sucked out together with the ink from the nozzle 24 to the purge cap 103 by using the purge pump in a state in which the purge cap 103 is installed to the ink discharge surface 5.

Next, the ink-jet head 1 will be explained in detail with reference to FIGS. 2 to 5.

As shown in FIGS. 2 to 5, the ink-jet head 1 includes a flow passage unit 2 which is formed with individual ink flow passages 25 including pressure chambers 16 therein, and an actuator unit 3 (transport force-applying mechanism) which is stacked on the upper surface of the flow passage unit 2.

Figure 4:
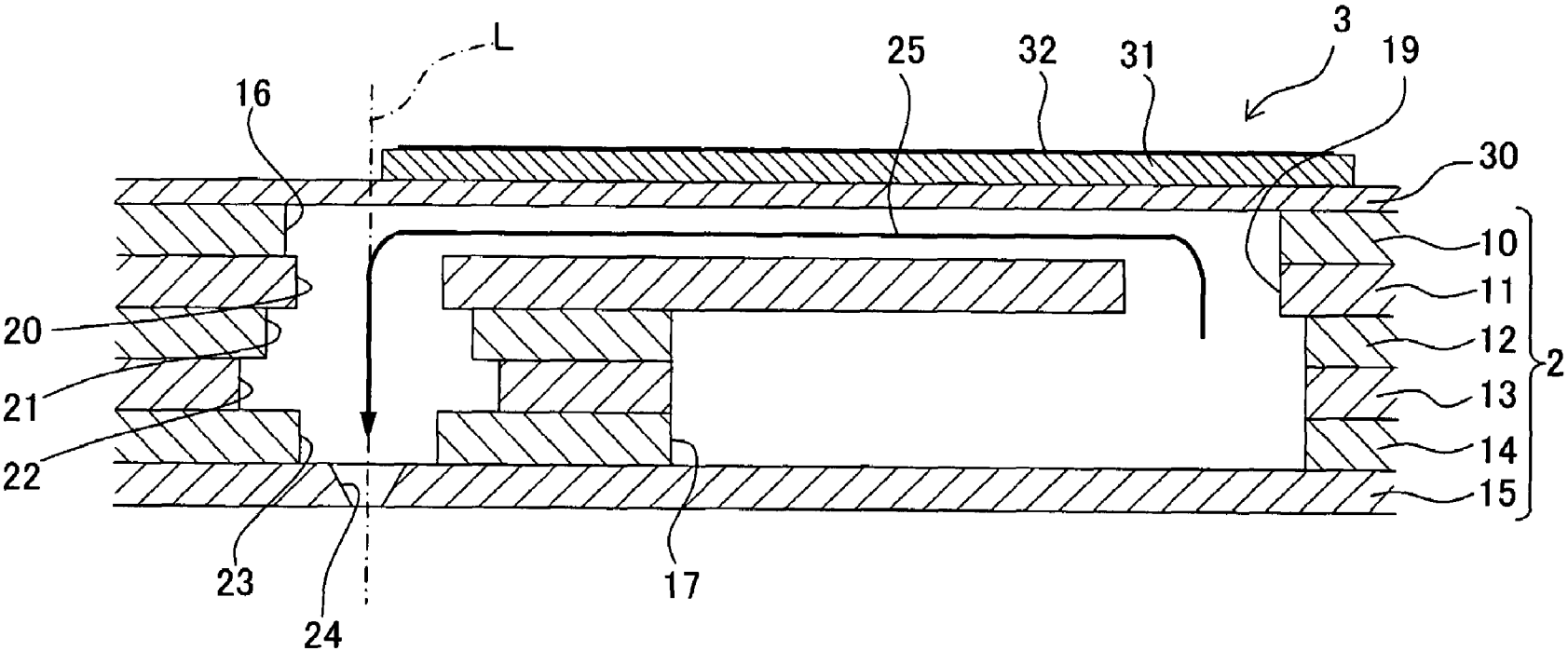
FIG. 4 shows a sectional view taken along a line IV-IV shown in FIG. 3.
Figure 5:
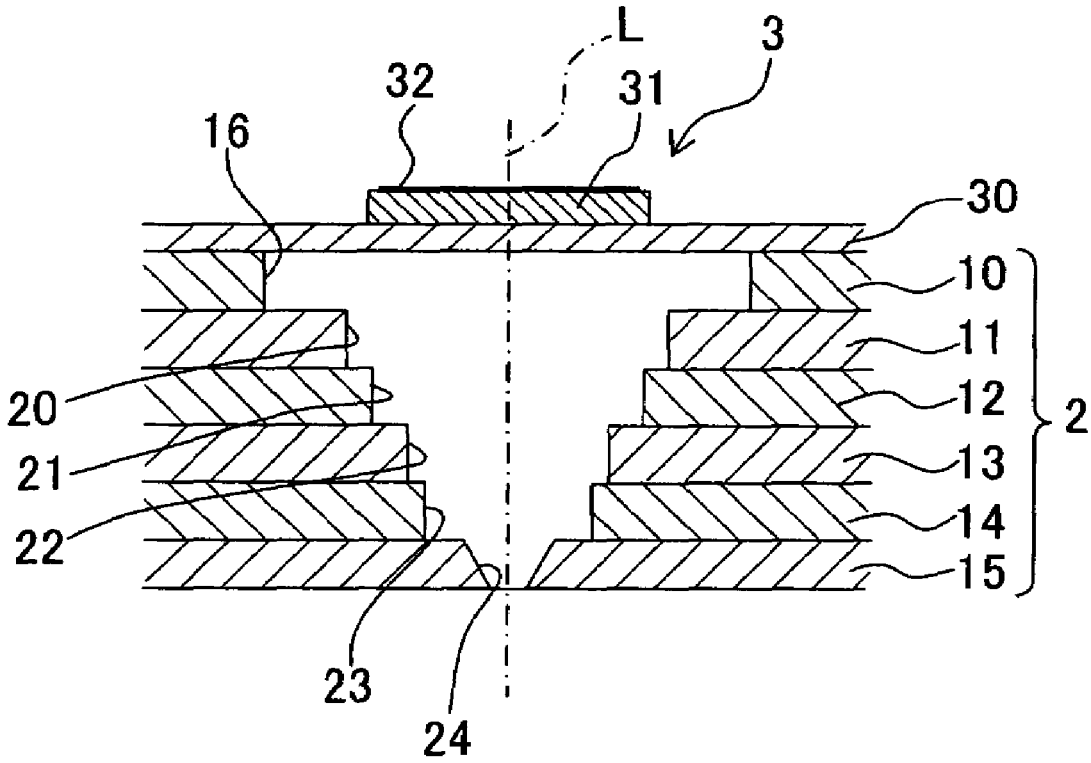
FIG. 5 shows a sectional view taken along a line V-V shown in FIG. 3.

At first, the flow passage unit 2 will be explained. As shown in FIG. 4, the flow passage unit 2 includes a cavity plate 10, a base plate 11, manifold plates 12, 13, 14, and a nozzle plate 15. The six plates 10 to 15 are adhered in a state of being stacked in this order from the upper position. In particular, the cavity plate 10, the base plate 11, and the manifold plates 12 to 14 are the plates which are made of stainless steel and which mutually have an equal thickness. The individual ink flow passages 25, which include the manifold 17 and the pressure chambers 16 as described later on, are formed in the five plates 10 to 14 by means of the etching. The nozzle plate 15 is formed of, for example, a high molecular weight synthetic resin material such as polyimide, and is adhered to the lower surface of the manifold plate 14. Alternatively, the nozzle plate 15 may be also formed of a metal material such as stainless steel in the same manner as the five plates 10 to 15.

As shown in FIGS. 2 to 5, the plurality of pressure chambers 16, which are arranged along the flat surface, are formed in the cavity plate 10. The plurality of pressure chambers 16 are open at the surface of the flow passage unit 2 (at the upper surface of the cavity plate 10 to which a vibration plate 30 is joined as described later on). The respective pressure chambers 16 are formed to be substantially elliptical as viewed in a plan view, and they are arranged so that the major axis directions thereof are in the left and right directions (scanning directions). An ink supply port 18, which is connected to an unillustrated ink tank, is formed in the cavity plate 10.

Figure 3:
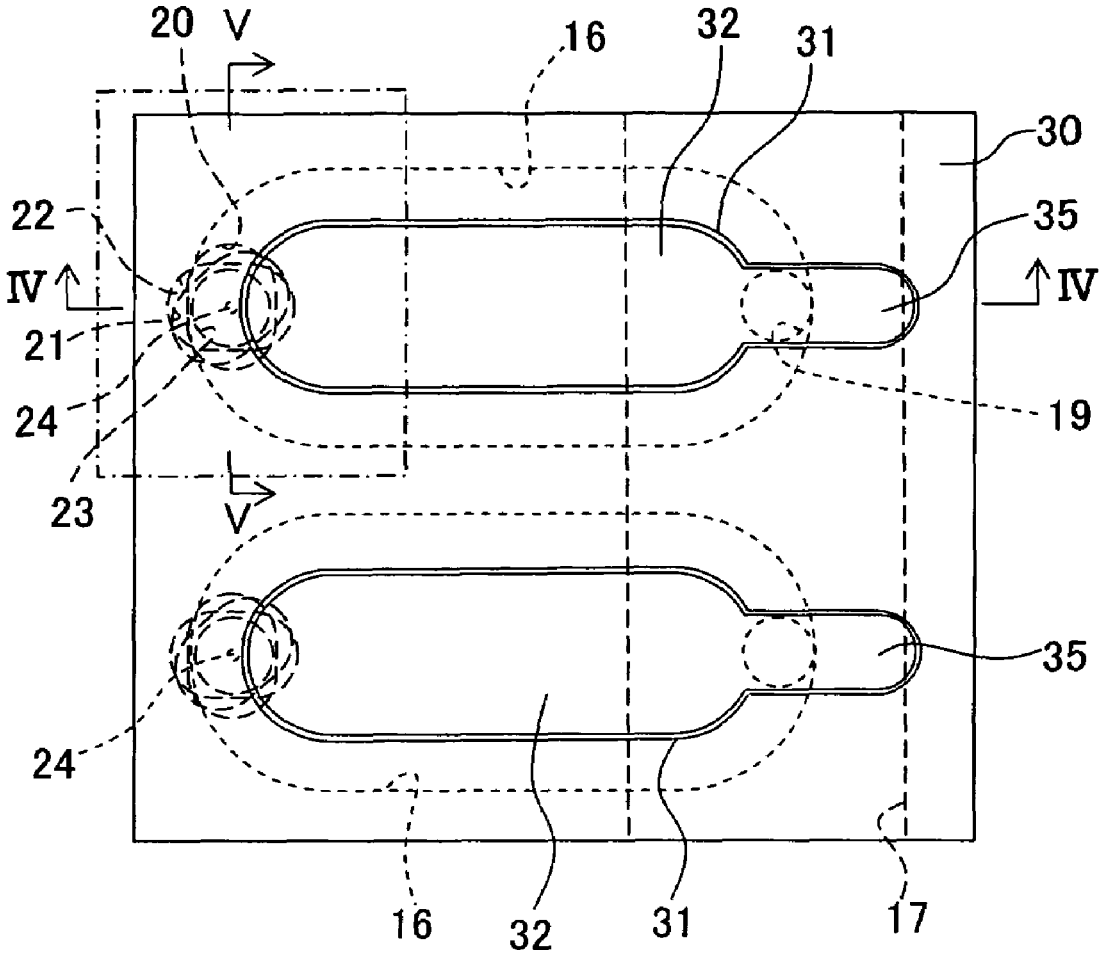
FIG. 3 shows a partial magnified view illustrating those shown in FIG. 2.

As shown in FIGS. 3 and 4, flow passage-forming holes 19, 20 are formed at positions of the base plate 11 overlapped with the both ends of the pressure chamber 16 in the major axis direction as viewed in a plan view respectively. The manifold 17, which extends in the paper feed direction (vertical direction as viewed in FIG. 2) and which is overlapped with any one of the left and right ends of each of the pressure chambers 16 as viewed in a plan view, is formed with the three manifold plates 12 to 14. The ink is supplied to the manifold 17 via the ink supply port 18 from the ink tank. The three manifold plates 12 to 14 have flow passage-forming holes 21, 22, 23 which are formed at positions overlapped with the flow passage-forming hole 20 as viewed in a plan view respectively. A plurality of nozzles 24 are formed in the nozzle plate 15 respectively at positions overlapped with the ends of the plurality of pressure chambers 16 disposed on the side opposite to the manifold 17 as viewed in a plan view. The nozzles 24 are formed, for example, by applying the excimer laser processing to a base plate made of a high molecular weight synthetic resin such as polyimide.

As shown in FIG. 4, the manifold 17 is communicated with the pressure chamber 16 via the flow passage-forming hole 19. Further, the pressure chamber 16 is communicated with the nozzle 16 via the flow passage-forming holes 20 to 23. As described above, the individual ink flow passage 25, which extends from the manifold 17 via the pressure chamber 16 to arrive at the nozzle 24, is formed in the flow passage unit 2. The flow passage-forming holes 20 to 23 are formed to have special shapes so that the bubbles contained in the individual ink flow passage 25 are discharged with ease (see FIG. 6), which will be explained in detail later on.

Next, the actuator unit 3 will be explained. As shown in FIGS. 2 to 5, the actuator unit 3 includes a vibration plate 30 which has conductivity and which is arranged on the surface of the flow passage unit 2, a piezoelectric layer 31 which is formed on the surface of the vibration plate 30, and a plurality of individual electrodes 32 which are formed on the surface of the piezoelectric layer 31 corresponding to the plurality of pressure chambers 16 respectively. The actuator unit 3 applies, to the ink contained in the pressure chambers 16, the pressure to serve as the force of transport of the ink to the nozzles 24. Accordingly, the ink is transported along the individual ink flow passages 25 to discharge the ink from the nozzles 24.

The vibration plate 30 is a plate made of stainless steel having a substantially rectangular shape as viewed in a plan view. The vibration plate 30 is stacked and joined on the upper surface of the cavity plate 10 in a state in which the openings of the plurality of pressure chambers 16 are closed thereby. The vibration plate 30 also serves as a common electrode which allows the electric field to act on the piezoelectric layer 31 between the individual electrodes 32 and the vibration plate 30 while being opposed to the plurality of individual electrodes 32.

The piezoelectric layer 31 is formed at the position opposed to the central portion of each of the pressure chambers 16 on the surface of the vibration plate 30. The piezoelectric layer 31 includes a major component of lead titanate zirconate (PZT) which is a ferroelectric substance and which is a solid solution of lead titanate and lead zirconate. The piezoelectric layer 31 has a substantially elliptical planar shape which is slightly smaller than the pressure chamber 16. The piezoelectric layer 31 can be formed, for example, such that a piezoelectric sheet, which is produced by sintering a green sheet of PZT, is cut and stuck on the vibration plate 30. Alternatively, the piezoelectric layer 31 may be formed by depositing particles of PZT on the vibration plate 30, for example, by means of the aerosol deposition method (AD method) or the sputtering method.

The plurality of individual electrodes 32, each of which has substantially the same elliptical planar shape as that of the piezoelectric layer 31, are formed on the surface of the piezoelectric layer 31. The individual electrode 32 is composed of a conductive material such as gold. The individual electrode 32 is formed, for example, by means of the screen printing. Further, a plurality of terminal sections 35 are formed at first ends (left ends or right ends as viewed in FIG. 2) of the plurality of individual electrodes 32 respectively on the surface of the piezoelectric layer 31. The plurality of terminal sections 35 are electrically connected to a driver IC (not shown) via a flexible wiring member such as a flexible printed circuit board. The driving voltage is selectively supplied from the driver IC via the terminal sections 35 to the plurality of individual electrodes 32.

Next, an explanation will be made about the operation for discharging the ink by the actuator unit 3.

When the driving voltage is selectively supplied from the driver IC to the plurality of individual electrodes 32, a state is given, in which the electric potential is different between the individual electrode 32 which is disposed on the upper side of the piezoelectric layer 31 and to which the driving voltage is supplied and the vibration plate 30 which serves as the common electrode, which is disposed on the lower side of the piezoelectric layer 31, and which is retained to have the ground electric potential. The electric field in the vertical direction is generated at the portion of the piezoelectric layer 31 interposed between the individual electrode 32 and the vibration plate 30. Accordingly, the portion of the piezoelectric layer 31, which is disposed just under the individual electrode 32 to which the driving voltage is applied, contracts in the horizontal direction perpendicular to the vertical direction as the direction of polarization. In this situation, the vibration plate 30 is deformed so as to project toward the pressure chamber 16 in accordance with the horizontal contract of the piezoelectric layer 31. Therefore, the volume of the pressure chamber 16 is decreased, and the pressure is applied to the ink contained in the pressure chamber 16. Thus, the ink is discharged from the nozzle 24 communicated with the pressure chamber 16.

When the bubbles enter into the interior of the individual ink flow passage 25 including the pressure chamber 16 as described above, and the bubbles remain in the individual ink flow passage 25, then it is impossible to reliably apply the pressure to the ink contained in the pressure chamber 16 by the actuator unit 3 during the operation for discharging the ink as described above, and the ink is not discharged normally from the nozzle 24. In such a situation, in the case of the ink-jet head 1 of this embodiment, it is possible, to some extent, to discharge the bubbles staying in the individual ink flow passage 25 by forcibly sucking the ink from the nozzle 24 by using the purge mechanism provided with the purge cap 103 (see FIG. 8) as described above. However, the individual ink flow passage 25 includes, in some places, bent portions and portions in which the flow passage area is increased/decreased. The flow velocity of the ink is extremely small at the corners formed at the portions as described above. Therefore, the bubbles tend to stay at the corners with ease. Further, the ink flow passage is formed such that the flow passage area is suddenly decreased in the vicinity of the nozzle 24. The bubbles tend to stay especially easily at the corners (Points A shown in FIG. 8) in the vicinity of the nozzle 24. Therefore, it is difficult to completely discharge the bubbles staying at the corners as described above by only the purge operation performed by the purge mechanism.

Figure 6A:
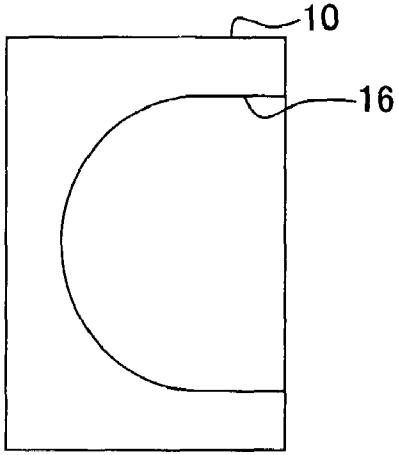
FIG. 6A shows a cavity plate.
Figure 6B:
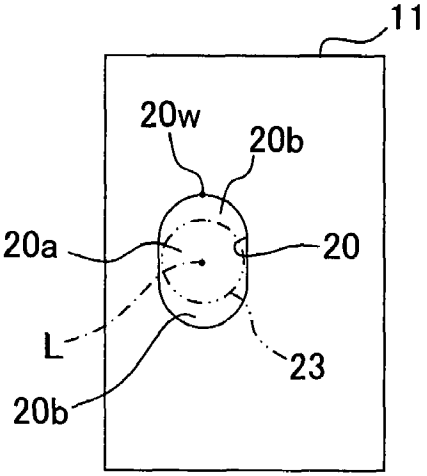
FIG. 6B shows a base plate.
Figure 6C:
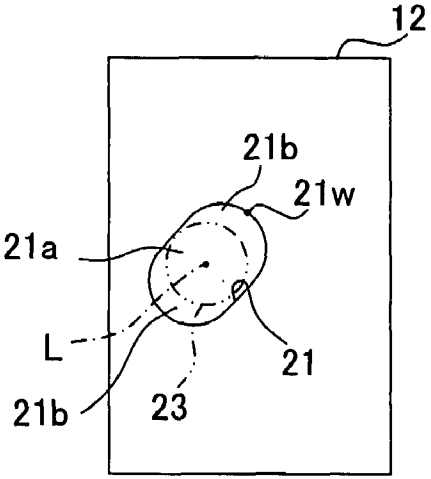
FIGS. 6C to 6E show manifold plates.
Figure 6D:
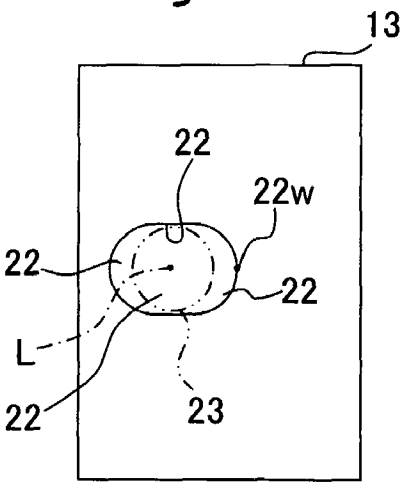
Figure 6E:
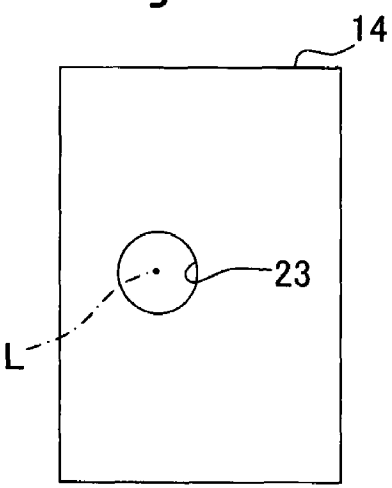
Figure 6F:
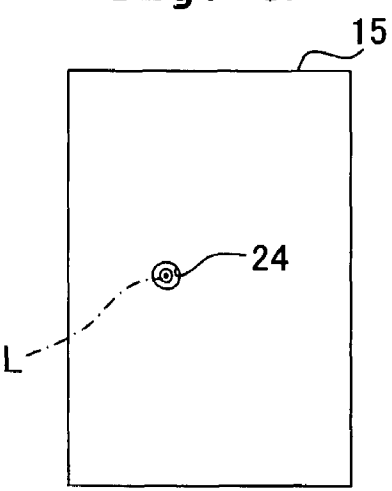
FIG. 6F shows a nozzle plate.

Accordingly, in the case of the ink-jet head of the embodiment of the present invention, the flow passage-forming holes 20 to 23, which are included in the individual ink flow passage 25 and which constitute the ink flow passage starting from the pressure chamber 16 and leading to the nozzle 24, are formed as follows in order to easily discharge the bubbles staying in the individual ink flow passage 25. As shown in FIGS. 6B to 6F, the flow passage-forming holes 20 to 23 are formed so that their center lines are coincident with the axis L of the nozzle 24 respectively. Therefore, the axis L of the nozzle 24 is coincident with the axis of the flow passage defined by the flow passage-forming holes 20 to 23. As shown in FIG. 6A, the pressure chamber 16 is formed in the cavity plate 10. As shown in FIG. 6B, the base plate 11, which is disposed just under the cavity plate 10, has the flow passage-forming hole 20 which is formed to have the elliptical shape that is long in the paper feed direction (vertical direction as viewed in FIG. 6B) at the position overlapped with the end of the pressure chamber 16. Further, as shown in FIG. 6C, the manifold plate 12, which is disposed at the uppermost position of the three manifold plates, has the flow passage-forming hole 21 which has the same elliptical planar shape as that of the flow passage-forming hole 20 of the base plate 11 and which is formed at the position deviated from the flow passage-forming hole 20 by 45 degrees in the clockwise in the circumferential direction of the flow passage as viewed in a plan view (as viewed in the direction perpendicular to the plate). Further, as shown in FIG. 6D, the manifold plate 13, which is disposed at the second position from the top of the three manifold plates, has the flow passage-forming hole 22 which has the same elliptical planar shape as those of the flow passage-forming holes 20, 21 and which is formed at the position deviated by 45 degrees in the clockwise as viewed in a plan view with respect to the flow passage-forming hole 21 of the manifold plate 12. The longitudinal direction of the flow passage-forming hole 22 is parallel to the scanning direction (left and right directions as shown in FIG. 6D). That is, as for the flow passage-forming hole 21 and the flow passage-forming hole 20, their central positions are coincident with each other on the axis L. However, the flow passage-forming hole 21 is arranged at the orientation subjected to the rotational movement by 45 degrees with respect to the axis L respectively from the orientation of the flow passage-forming hole 20. Further, as for the flow passage-forming hole 22 and the flow passage-forming hole 21, their central positions are coincident with each other on the axis L. However, the flow passage-forming hole 22 is arranged at the orientation subjected to the rotational movement by 45 degrees with respect to the axis L respectively from the orientation of the flow passage-forming hole 21. Further, as shown in FIG. 6E, the manifold plate 14, which is disposed at the lowermost position of the three manifold plates, is formed with the flow passage-forming hole 23 having the perfect circular shape.

The diameter of the perfect circular flow passage-forming hole 23 is slightly shorter than the length of the minor axis of each of the elliptical flow passage-forming holes 20 to 22. As shown in FIGS. 6B to 6D, the flow passage-forming hole 23 is accommodated in the flow passage-forming holes 20 to 22 as viewed in a plan view. Therefore, those formed in the three elliptical flow passage-forming holes 20 to 22 are mainstream areas 20*a*, 21*a*, 22*a* which are overlapped with the perfect circular flow passage-forming hole 23 as viewed in a plan view respectively and through which the mainstream Fm of the ink may flow (see FIG. 8), and two branch areas 20*b*, 21*b*, 22*b* which protrude outwardly from the mainstream areas 20*a*, 21*a*, 22*b* respectively and through which the branch Fs may flow outside the mainstream Fm (see FIGS. 7 and 8). That is, in this embodiment, the "mainstream areas" refer to the openings of the areas (opening portions) 20*a*, 21*a*, 22*a* which are overlapped with each other in the direction of the axis L of the flow passage-forming holes 20 to 22 of the base plate 11 and the manifold plates 12 to 13. The "branch areas" refer to the portions other than the mainstream areas of the flow passage-forming holes 20 to 22 of the base plate 11 and the manifold plates 12 to 13.

Figure 7:
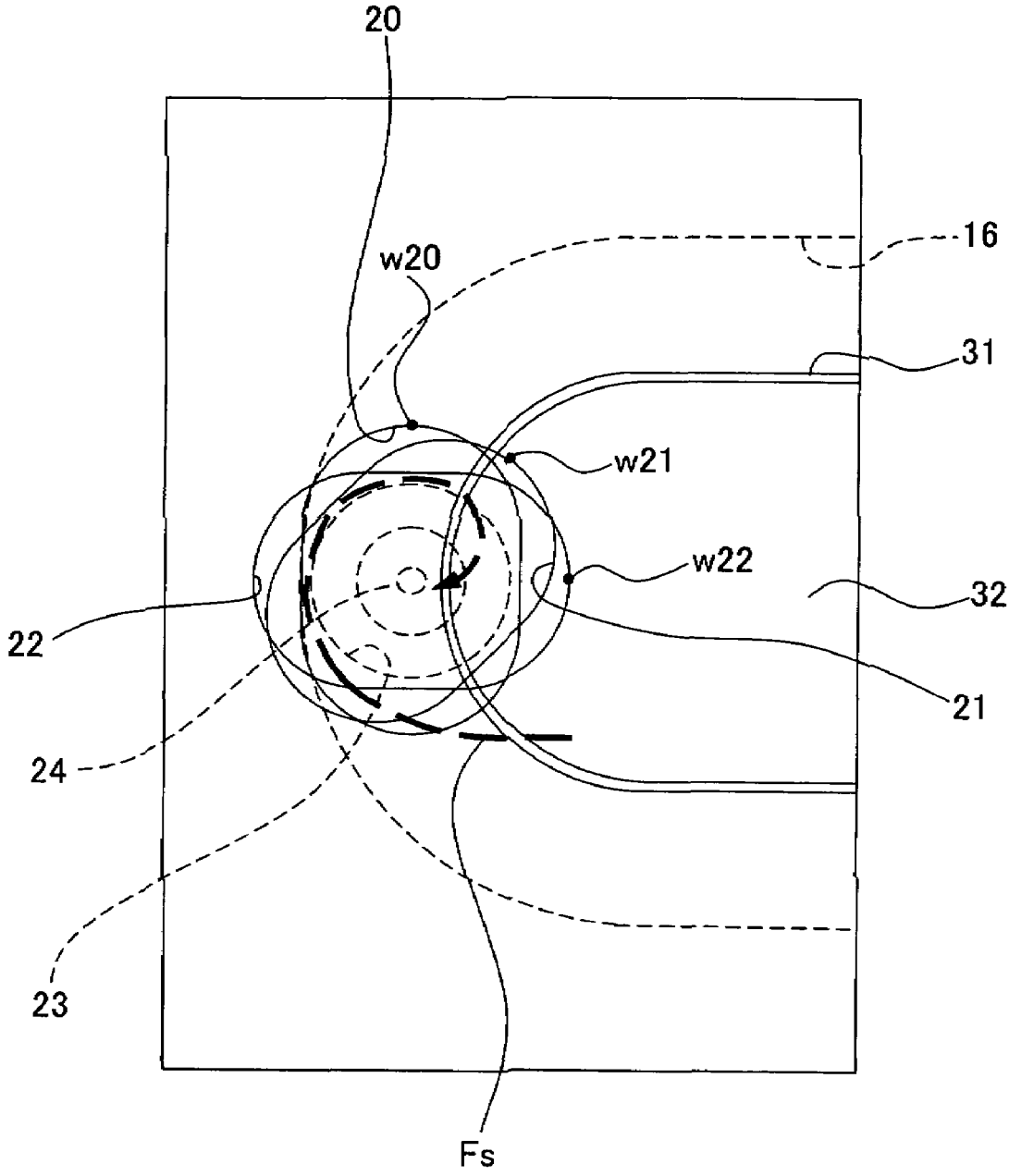
FIG. 7 shows a magnified plan view illustrating an area surrounded by one-dot chain line shown in FIG. 3.
Figure 8:
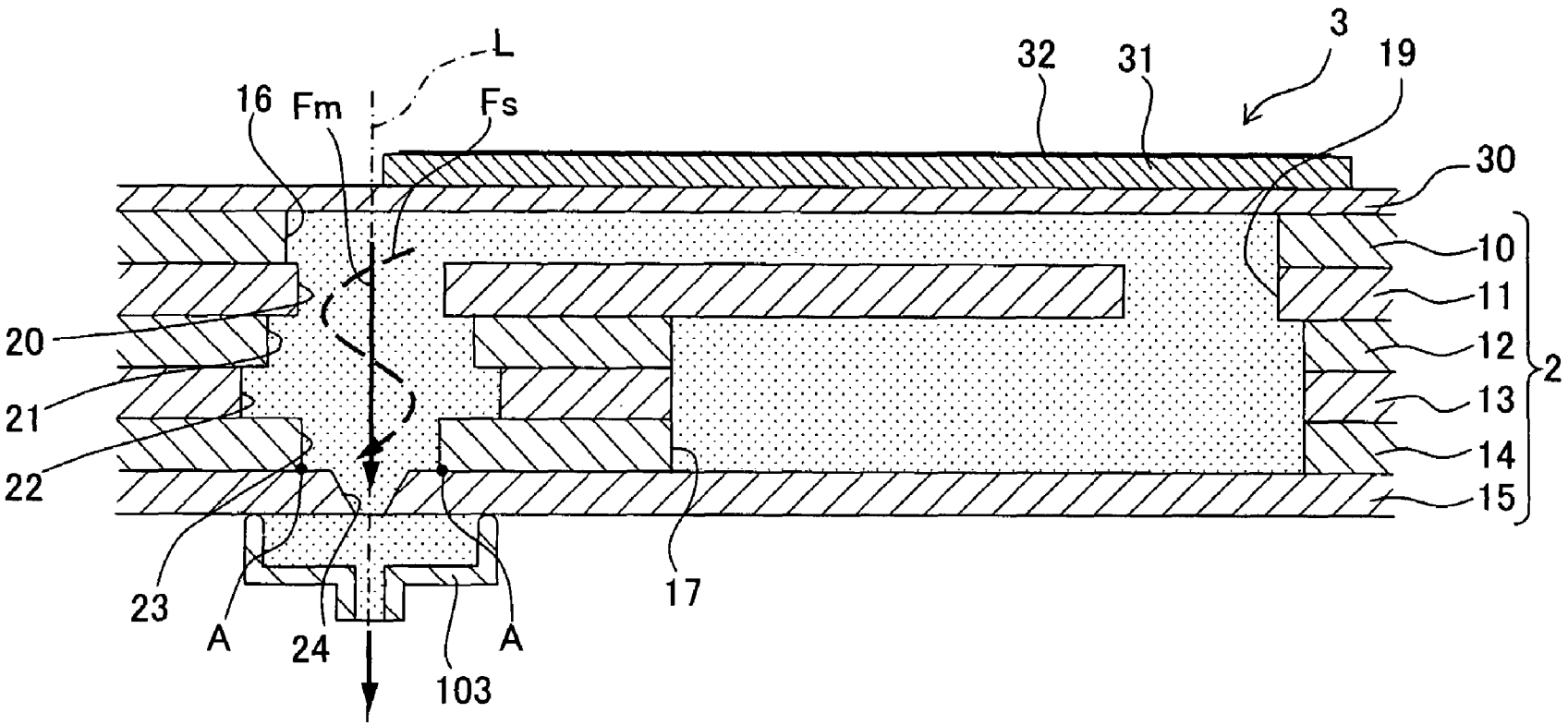
FIG. 8 shows a sectional view corresponding to FIG. 4, during the purge operation.

The branch areas 20*b*, 21*b*, 22*b*, which are formed in the elliptical flow passage-forming holes 20 to 22, are respectively partially overlapped with the branch areas of other flow passage-forming holes adjoining in the vertical direction which is the stacking direction of the plates. Further, the branch areas 20*b*, 21*b*, 22*b* of the three flow passage-forming holes 20 to 22 respectively are successively deviated by 45 degrees in the clockwise about the center of the axis L, and the branch areas 20*b*, 20*b*, 22*b* are arranged in a spiral form. Each of the flow passage-forming holes 20 to 22 is elliptical. Therefore, the points 20*w*, 21*w*, 22*w*, which are disposed on the major axes on the outer circumferences of the ellipses, are the points disposed farthest from the center of the ellipses (and the axis L). The points 20*w*, 21*w*, 22*w* are also deviated successively by 45 degrees in the clockwise about the center of the axis L, and they are arranged to depict the spiral toward the nozzle. Therefore, when the ink flows to the nozzle 24 along the individual ink flow passage 25 during the normal discharge of the ink upon the recording on the recording paper P and during the purge operation performed by purge mechanism, the mainstream Fm of the ink flows along the axis L of the nozzle 24 in the mainstream areas 20*a*, 21*a*, 22*b*. However, the branch Fs of the ink, which is disposed outside the mainstream, flows the branch areas 20*b*, 21*b*, 22*b* arranged in the spiral form, during which the branch Fs forms the vortex flow as shown in FIGS. 7 and 8. Accordingly, the flow velocity of the ink is increased in the vicinity of the wall surface of the individual ink flow passage 25, and the bubbles, which stay in the vicinity of the wall surface (especially at the corners A), are reliably discharged. Therefore, it is unnecessary to perform the purge operation many times in order to discharge the bubbles. Therefore, the amount of the ink, which is discharged during the purge operation, is decreased, and it is possible to efficiently use the ink. Further, the vortex flow can be generated in the individual ink flow passage 25 by using only the three flow passage-forming holes 20 to 22 having the elliptical shapes arranged in the spiral form while being deviated from each other in the circumferential direction. Therefore, the structure, which is required to generate the vortex flow, is extremely simple, which is advantageous in view of the production cost of the ink-jet head 1.

In this embodiment, the difference in diameter appears between the adjoining flow passage-forming holes 20 to 23. Due to the difference in diameter as described above, the bubbles also tend to stay easily at the corners formed at the circumferential edge portions (stepped portions) of the flow passage-forming holes 20 to 23. However, in this embodiment, the two branch areas 20*b*, 21*b*, 22*b*, which are formed in each of the elliptical flow passage-forming holes 20 to 22, are arranged symmetrically (while forming the angle of 180 degrees in the circumferential direction) in relation to the axis L. The branch Fs of the ink uniformly flows in the circumferential direction while forming the two vortex flows which are symmetrical in relation to the axis L, respectively from the start points of the two branch areas 20*b* of the flow passage-forming hole 20 disposed at the uppermost position of the flow passage-forming holes 20 to 22. Therefore, it is possible to reliably discharge the bubbles staying at the corners formed by the difference in diameter between the flow passage-forming holes 20 to 22.

All of the three plates of the base plate 11, the manifold plate 12, and the manifold plate 13 are the plates having the same thickness. The angle, at which each of the branch areas 20*b*, 21*b*, 22*b* is deviated in the circumferential direction with respect to the another branch area adjoining in the vertical direction, is identical, which is 45 degrees in relation to all of the six branch areas 20*b*, 21*b*, 22*b*. Therefore, the branch Fs in the vortex form, which is generated in the branch areas 20*b*, 21*b*, 22*b*, is not bent in any direction other than in the spiral direction (circumferential direction), and the branch Fs stably flows to the nozzle 24. When the base plate 11, the manifold plate 12, and the manifold plate 13 have different thicknesses, then the angles, at which the flow passage-forming holes 20 to 22 are deviated in the circumferential direction, are established in proportion to the thicknesses, and thus it is possible to stabilize the flow of the branch Fs in the vortex form directed toward the nozzle 24. Further, the mainstream areas 20*a*, 21*a*, 22*a* and the branch areas 20*b*, 21*b*, 22*b*, which are formed in the flow passage-forming holes 20 to 22 respectively, are connected to one another. Therefore, the ink does not flow in a separated manner through the mainstream Fm and the branch Fs. The entire flow of the ink is smoothened.

Next, an explanation will be made about modified embodiments in which various modifications are applied to the embodiment described above. However, the components or parts, which are constructed in the same manner as in the embodiment described above, will be designated by the same reference numerals, any explanation of which will be appropriately omitted.

First Modified Embodiment

Figure 9A:
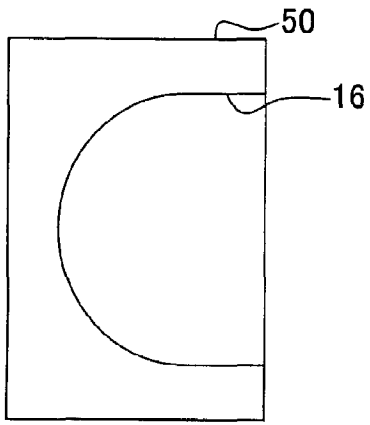
FIG. 9A shows a cavity plate.
Figure 9B:
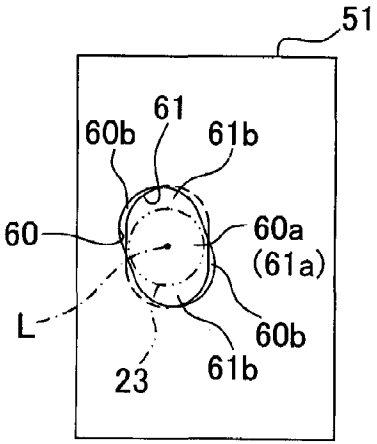
FIG. 9B shows a base plate.
Figure 9C:
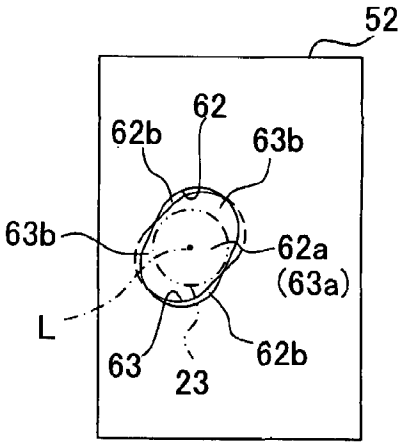
FIGS. 9C to 9E show manifold plates.
Figure 9D:
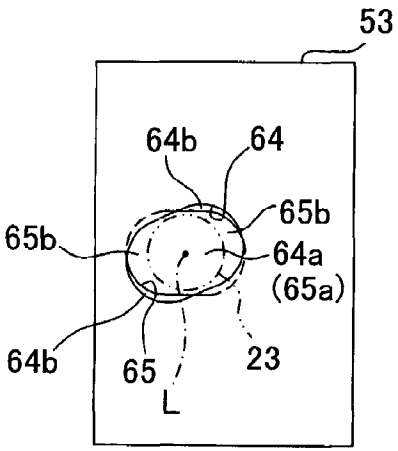
Figure 9E:
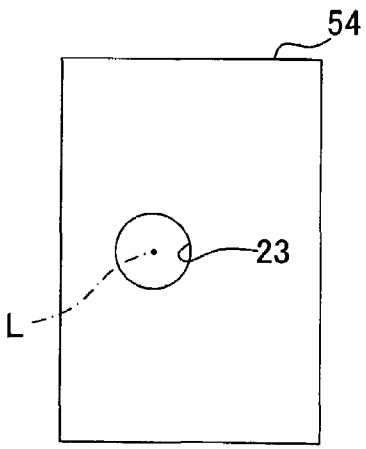
Figure 9F:
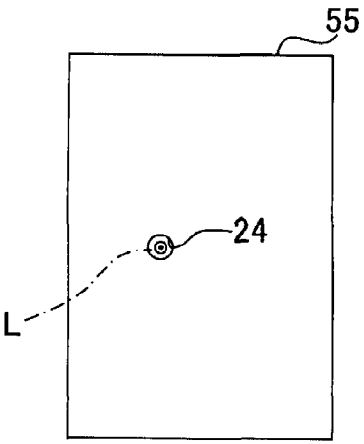
FIG. 9F shows a nozzle plate.
Figure 10:
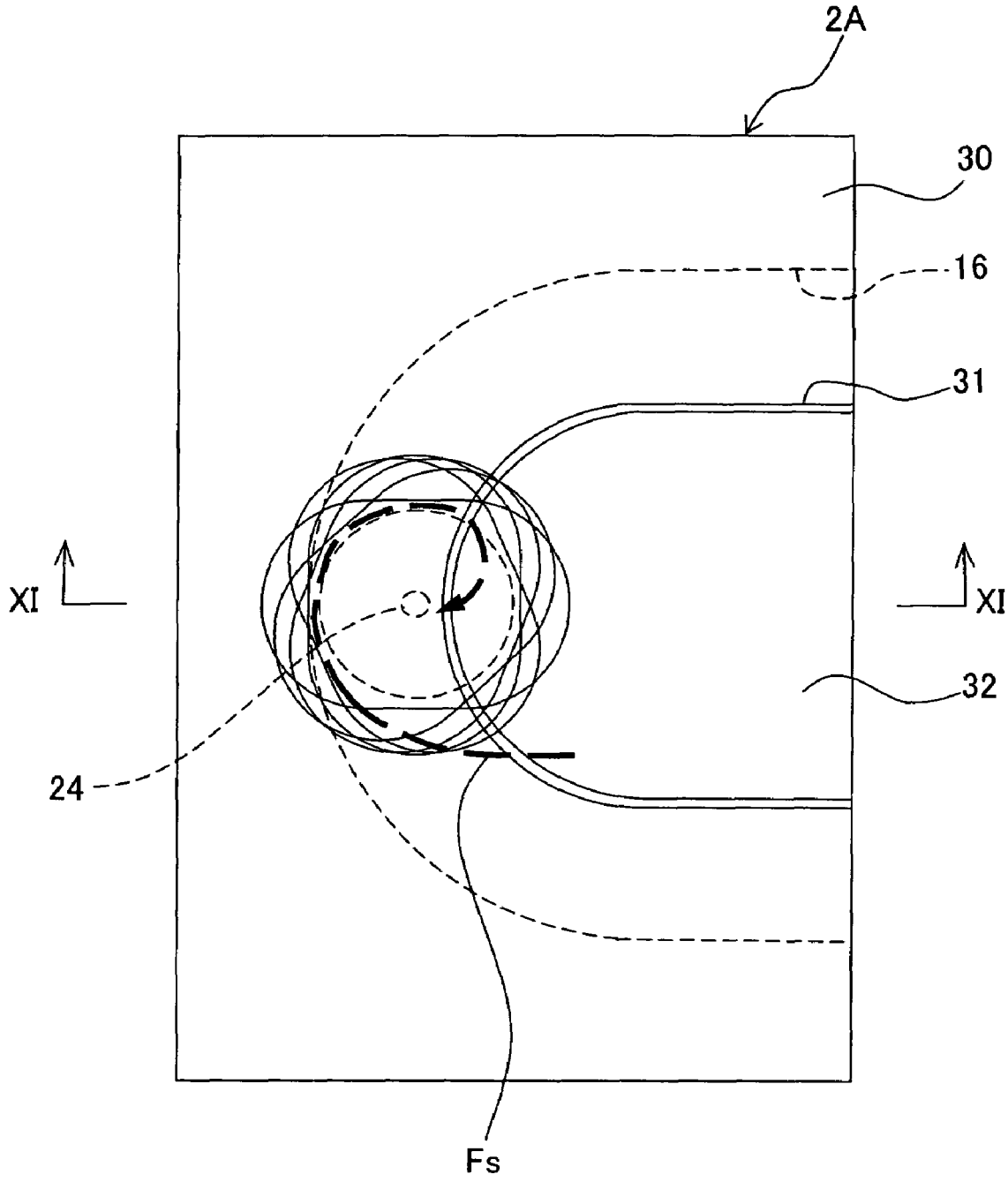
FIG. 10 shows a magnified plan view illustrating an ink-jet head corresponding to FIG. 7 in the first modified embodiment.
Figure 11:
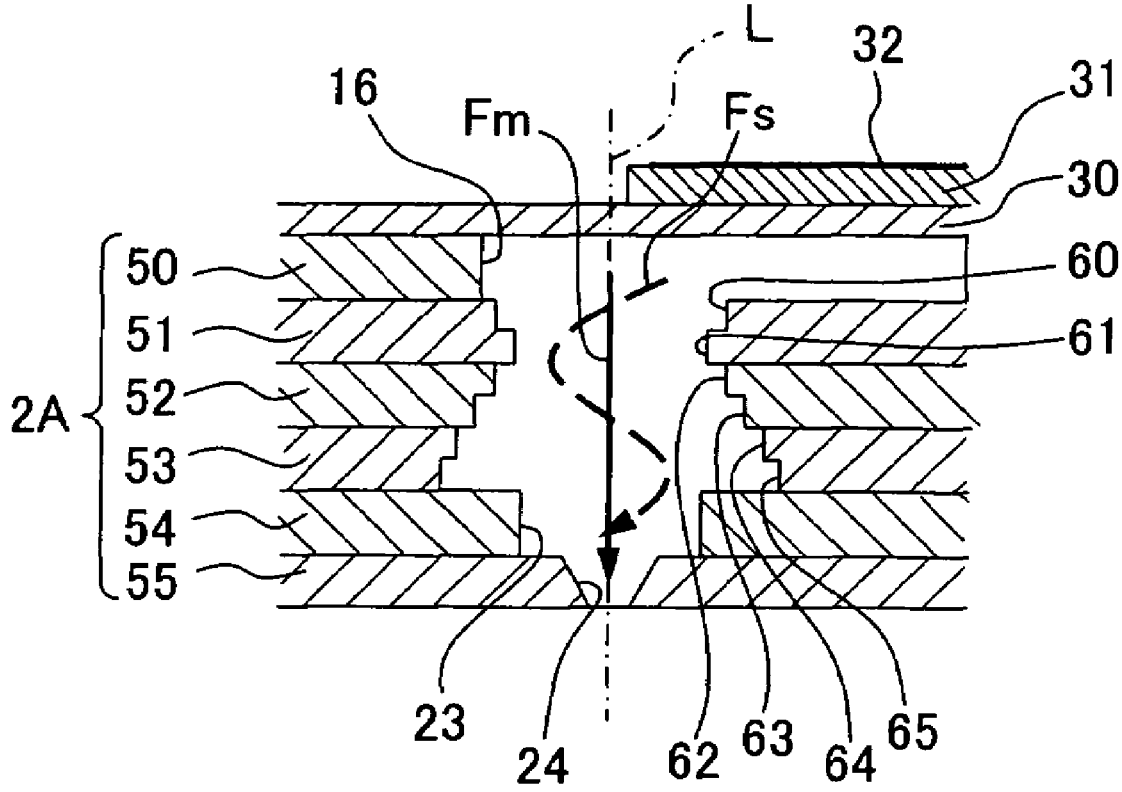
FIG. 11 shows a sectional view taken along a line XI-XI shown in FIG. 10.

In the ink-jet head 1 of the embodiment described above, one flow passage-forming hole is formed for one plate, and the three flow passage-forming holes are arranged while being deviated in the circumferential direction in each of the plates. However, a plurality of flow passage-forming holes, which are deviated from each other in the circumferential direction, may be formed for one plate. For example, a flow passage unit 2A of a first modified embodiment shown in FIGS. 9A to 9F, 10, and 11 has such a structure that a cavity plate 50, a base plate 51, manifold plates 52, 53, 54, and a nozzle plate 55 are stacked. As shown in FIGS. 9B and 11, the base plate 51 has two flow passage-forming holes 60, 61 which are communicated vertically with each other, which are mutually deviated by 22.5 degrees in the circumferential direction as viewed in a plan view, and which are formed by means of the half etching. Similarly, the manifold plate 52 is formed with two flow passage-forming holes 62, 63 as shown in FIG. 9C, and the manifold plate 53 is also formed with two flow passage-forming holes 64, 65 as shown in FIG. 9D. All of the six flow passage-forming holes 60 to 65 have the same elliptical planar shape. As shown in FIG. 10, the six flow passage-forming holes 60 to 65, which are formed in the three plates 51 to 53, are arranged while being deviated from each other by 22.5 degrees in the clockwise in the circumferential direction.

Therefore, mainstream areas 60*a*, 61*a*, 62*a*, 63*a*, 64*a*, 65*a* of the six flow passage-forming holes 60 to 65, which are overlapped with the flow passage-forming hole 23, are arranged so that they are overlapped with each other as viewed in a plan view. On the other hand, branch areas 60*b*, 61*b*, 62*b*, 63*b*, 64*b*, 65*b*, which are positioned outside the mainstream areas 60*a* to 65*a* respectively, are arranged in a spiral form while being successively deviated in the clockwise. The branch Fs of the ink, which flows through the branch areas 60*b* to 65*b*, forms the vortex flow. As described above, when two or more of the flow passage-forming holes are formed for one plate, it is possible to decrease the angle of deviation between the adjoining flow passage-forming holes. Thus, the branch Fs of the ink, which forms the vortex flow, flows more stably and smoothly.

Second Modified Embodiment

Figure 12A:
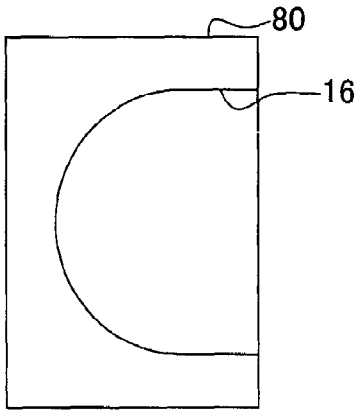
FIG. 12A shows a cavity plate.
Figure 12B:
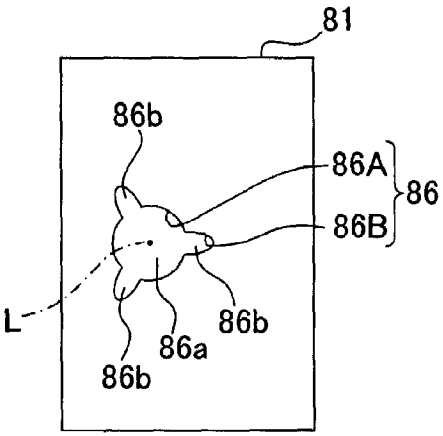
FIG. 12B shows a base plate.
Figure 12C:
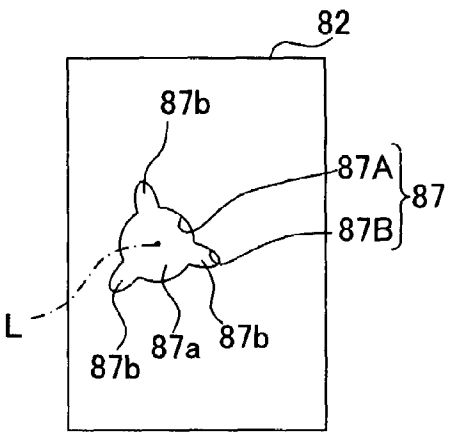
FIGS. 12C to 12E show manifold plates.
Figure 12D:
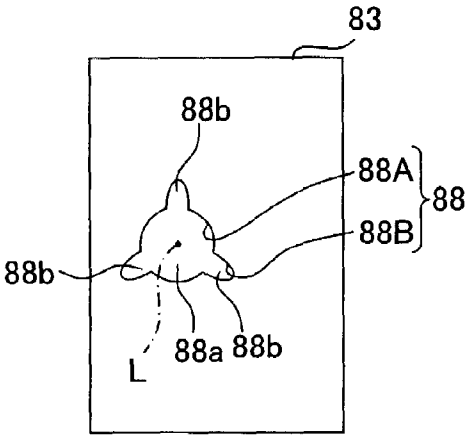
Figure 12E:
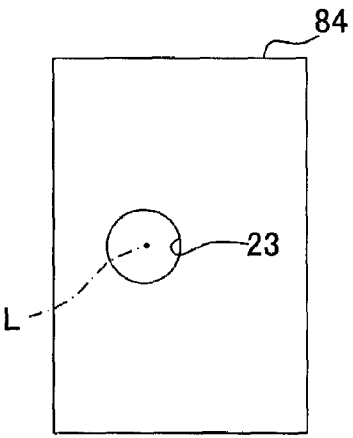
Figure 12F:
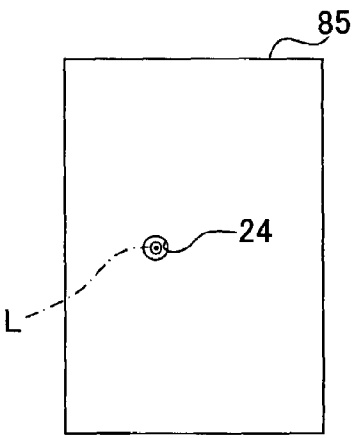
FIG. 12F shows a nozzle plate.
Figure 13:
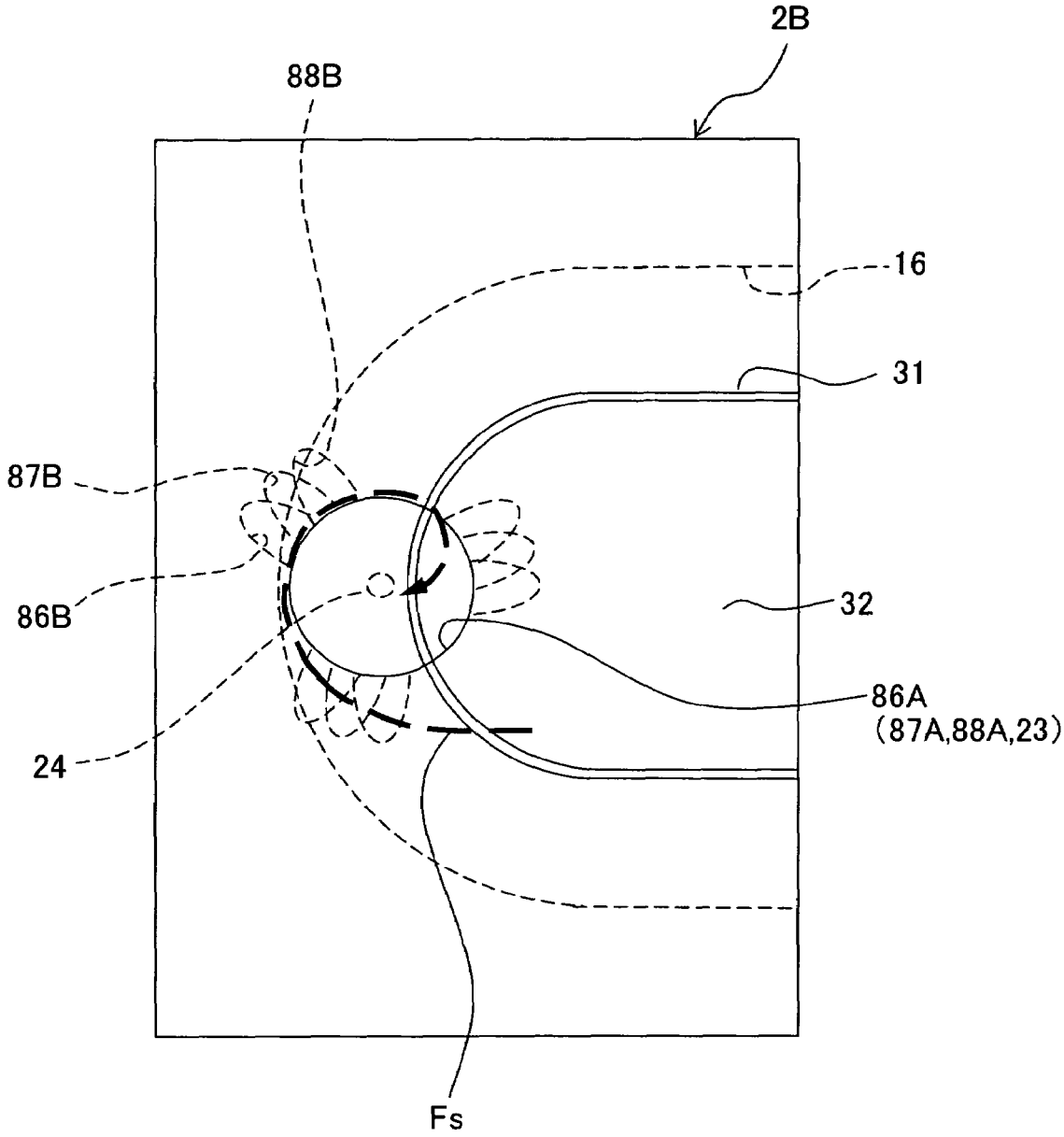
FIG. 13 shows a magnified plan view illustrating an ink-jet head corresponding to FIG. 7 in the second modified embodiment.

The number of the branch areas formed in one flow passage-forming hole is not limited to two as in the embodiment described above, which may be one or any plural number, i.e., three or more. For example, a flow passage unit 2B according to a second modified embodiment shown in FIGS. 12A to 12F and 13 has such a structure that a cavity plate 80, a base plate 81, manifold plates 82, 83, 84, and a nozzle plate 85 are stacked. As shown in FIG. 12B, the base plate 81 is formed with a flow passage-forming hole 86 including a circular hole 86A which is overlapped with a perfect circular flow passage-forming hole 23 formed for the manifold plate 84, and three cutouts 86B which are cut out radially outwardly from the circular hole 86A. The three cutouts 86B are arranged at equal angular intervals of 120 degrees in the circumferential direction. Similarly, as shown in FIG. 12C, the manifold plate 82 is formed with a flow passage-forming hole 87 composed of a circular hole 87A and three cutouts 87B. Further, as shown in FIG. 12D, the manifold plate 83 is also formed with a flow passage-forming hole 88 composed of a circular hole 88A and three cutouts 88B. The centers of the circular holes 86A, 87A, 88A and the flow passage-forming hole 23 are coaxially arranged on the axis L respectively. The apex portions of the cutouts 86B, 87B, 87C are the points disposed farthest from the axis L (inner wall portion of the flow passage-forming hole). Also in this embodiment, the outermost portions of the walls for defining the flow passage-forming holes (through-holes) of the plurality of plates, which are disposed farthest from the axis L, are arranged to depict the spiral about the center of the axis L as the positions of the outermost portions approach the liquid discharge port. As shown in FIG. 13, the three flow passage-forming holes 86 to 88 are respectively arranged while being successively deviated from each other by 15 degrees in the circumferential direction (being subjected to the rotational movement by 15 degrees about the center of the axis L).

Therefore, mainstream areas 86*a* to 88*a*, which are formed by the circular holes 86A to 88A, are arranged while being overlapped with each other. On the other hand, branch areas 86*b* to 88*b*, which are formed by the cutouts 86B to 88B, respectively, are arranged in the spiral form. The branches Fs, which flow through the branch areas 86*b* to 88*b*, flow to the nozzle 24 while forming the three vortexes flows which are symmetrical in relation to the axis L of the nozzle 24. Therefore, an effect to discharge the bubbles, which is equivalent to the effect obtained in the embodiment described above, is obtained.

As the number of branch areas formed in one flow passage-forming hole is larger, the number of vortex flows becomes larger, by which it is possible to discharge the bubbles more reliably. However, when the number of branch areas is increased, the shape of the flow passage-forming hole is complicated, which is disadvantageous in view of the production cost. Therefore, it is preferable that the number of branch areas is appropriately established considering, for example, the effect to discharge the bubbles and the production cost.

Third Modified Embodiment

Figure 14A:
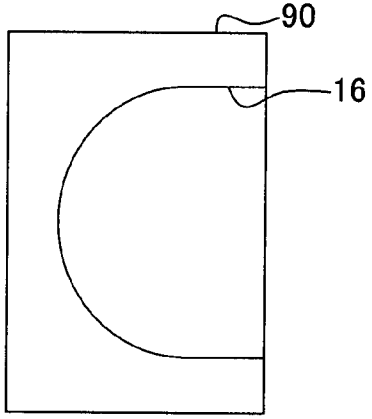
FIG. 14A shows a cavity plate.
Figure 14B:
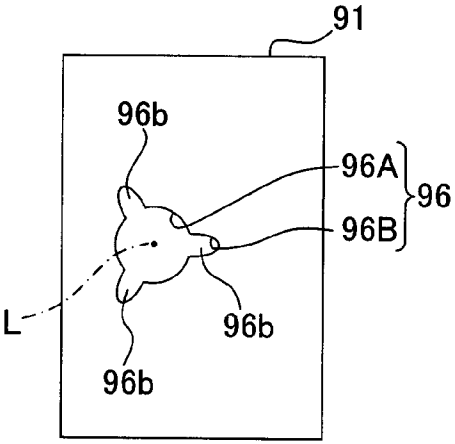
FIG. 14B shows a base plate.
Figure 14C:
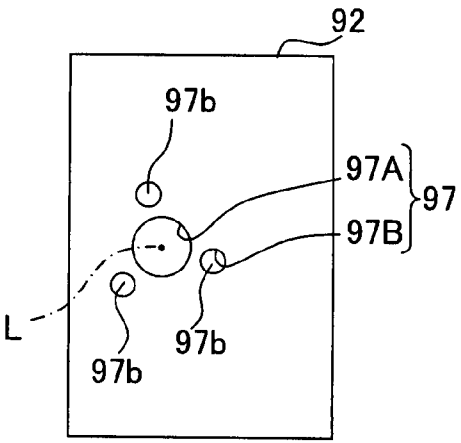
FIGS. 14C to 14E show manifold plates.
Figure 14D:
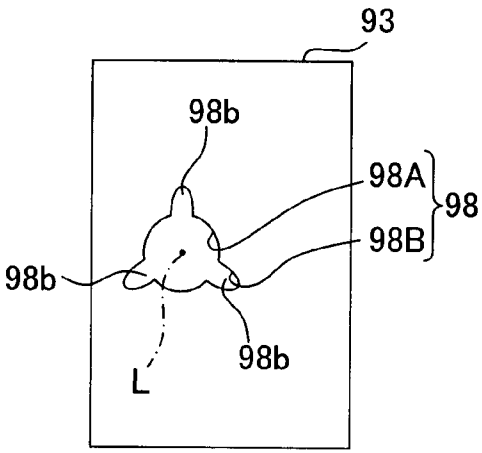
Figure 14E:
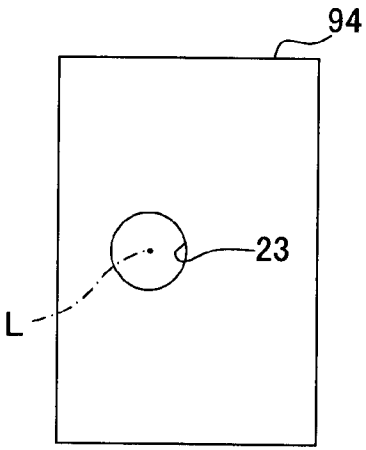
Figure 14F:
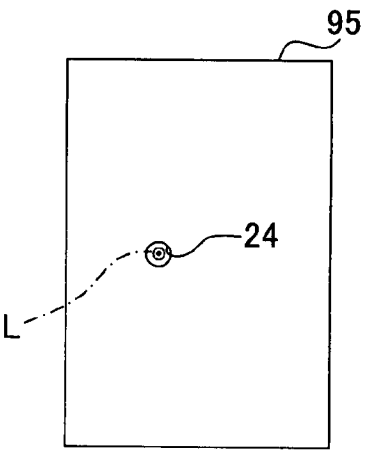
FIG. 14F shows a nozzle plate.
Figure 15:
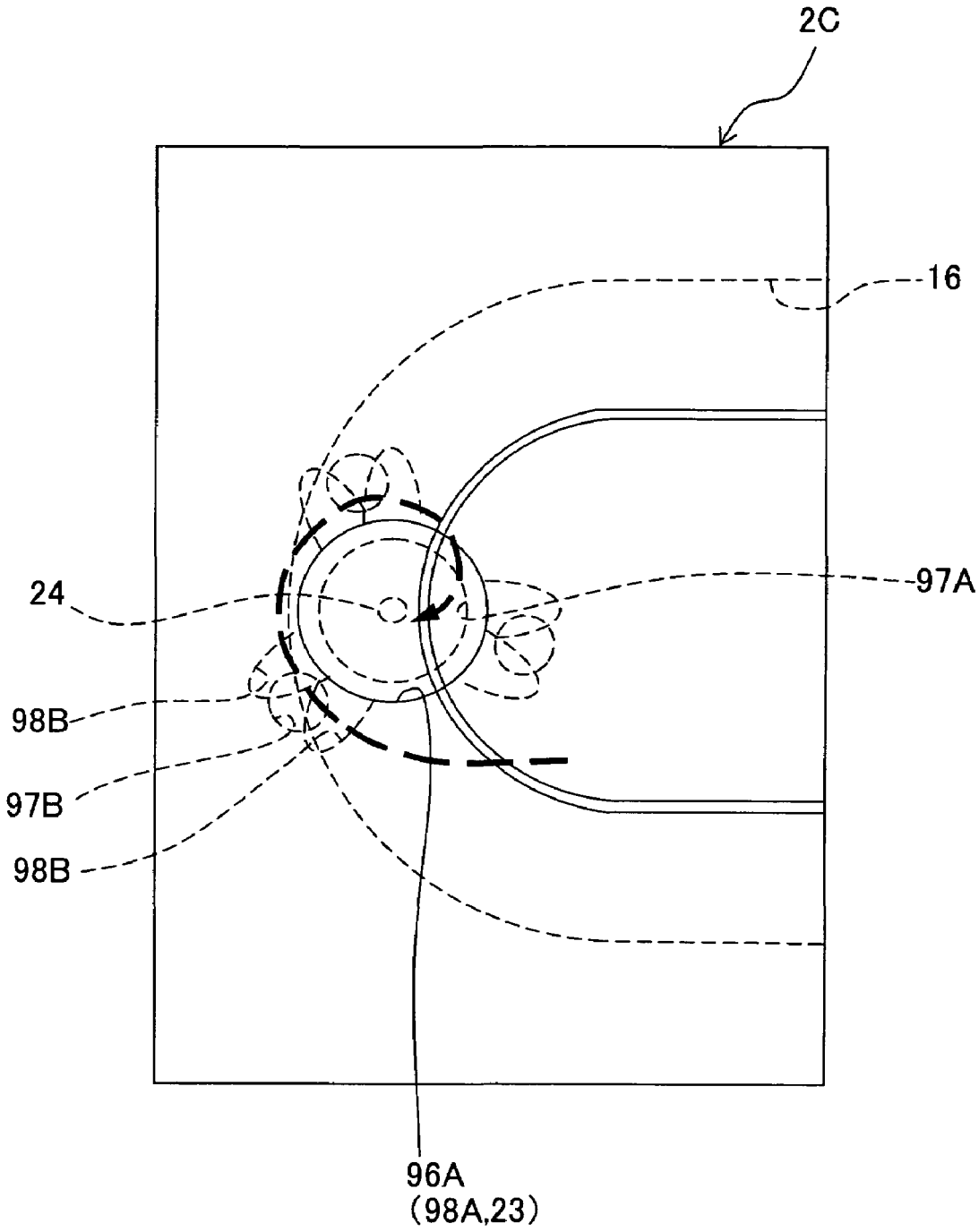
FIG. 15 shows a magnified plan view illustrating an ink-jet head corresponding to FIG. 7 in the third modified embodiment.

It is not necessarily indispensable that the mainstream area and the branch area are connected to one another. For example, a flow passage unit 2C according to a third modified embodiment shown in FIGS. 14A to 14F and 15 has such a structure that a cavity plate 90, a base plate 91, manifold plates 92, 93, 94, and a nozzle plate 95 are stacked. As shown in FIG. 14B, the base plate 91 is formed with a flow passage-forming hole 96 which has a circular hole 96A and three cutouts 96B (96*b*, 96*b*, 96*b*) in the same manner as the flow passage-forming hole 86 (see FIG. 12B) of the flow passage unit 2B according to the second modified embodiment described above. As shown in FIG. 14D, the second manifold plate 93 is also formed with a flow passage-forming hole 98 which has a circular hole 98A and three cutouts 98B (98*b*, 98*b*, 98*b*) in the same manner as described above. On the other hand, the manifold plate 92, which is disposed between the two plates 91, 93, includes a circular hole 97A which is overlapped with the circular holes 96A, 98A, and three circular holes 97B (97*b*, 97*b*, 97*b*) which are formed on the outer side in the radial direction from the circular hole 97A while being separated from the circular hole 97A. The three circular holes 97A are arranged while being deviated by 15 degrees in the clockwise respectively with respect to the three cutouts 96B of the adjoining flow passage-forming hole 96. Therefore, as shown in FIG. 15, branch areas 96*b* formed by the cutouts 96B of the flow passage-forming hole 96, branch areas 97*b* formed by the circular holes 97B of the flow passage-forming holes 97, and branch areas 98*b* formed by the cutouts 98B of the flow passage-forming hole 98 are arranged in the spiral form. The branches Fs, which flow through the branch areas 96*b*, 97*b*, 98*b*, form the vortex flows to flow to the nozzle 24. In the manifold plate 92, the portions of the walls for defining the flow passage-forming holes 97, which are disposed farthest from the axis L, exist not in the circular hole 97A but on the inner walls of the three circular holes 97B (97*b*, 97*b*, 97*b*).

Fourth Modified Embodiment

It is not necessarily indispensable that the center lines of a plurality of flow passage-forming holes are completely coincident with each other. It is enough that the flow passage-forming holes have the areas (mainstream areas) overlapped in the direction of the nozzle axis L. For example, when the flow passage-forming holes are perfect circles having the same diameter or different diameters respectively, the centers of the circles may be offset from the nozzle axis L. In this arrangement, the points on the outer circumferences of the flow passage-forming holes, which are disposed farthest from the nozzle axis L, may be displaced to orbit around the nozzle axis L as the positions of the outermost portions approach the nozzle.

In the embodiment and the modified embodiments described above, the shape of the flow passage-forming hole is not limited to those of the flow passage-forming holes explained in the embodiment and the first to fourth modified embodiments described above. A plurality of flow passage-forming holes may have shapes having portions expanded outwardly partially from the outer circumferential portions of the perfect circles respectively. On this condition, a mainstream area and spiral branch areas can be formed by merely arranging the plurality of flow passage-forming holes while being deviated from each other in the circumferential direction. Therefore, it is possible to adopt not only those having the shapes including the curved portions but also those having various shapes including, for example, polygonal shapes such as rectangular shapes and triangular shapes.

The ink-jet head 1 of the embodiment described above is constructed so that the vortex flow is generated in the ink flow passage starting from the pressure chamber 16 and leading to the nozzle 24 by the aid of the flow passage-forming holes 20 to 23. However, the ink flow passage, which starts from the manifold 17 and leads to the pressure chamber 16, can be also constructed so that the vortex flow is generated in accordance with the same or equivalent structure.

The transport force-applying mechanism, which applies the transport force to the ink, is not limited to the actuator unit of the piezoelectric type of the embodiment described above. It is possible to adopt various mechanisms including, for example, pumps for pressurizing the liquid such as the ink and heaters to be used for the ink-jet head of the ink-heating type.

The embodiment and the modified embodiments described above are illustrative of the case in which the present invention is applied to the ink-jet head for discharging the ink after transporting the ink to the nozzles. However, the liquid transport apparatus, to which the present invention is applicable, is not limited to the ink-jet head. That is, it is unnecessary to provide the nozzle, and it is enough to provide the discharge port. For example, the present invention is also applicable to liquid transport apparatuses for transporting liquids other than the ink, including, for example, a liquid transport apparatus for transporting a liquid such as a chemical liquid or a biochemical solution in a micro total analysis system (μTAS) and a liquid transport apparatus for transporting a liquid such as a solvent or a chemical solution in a micro chemical system.

What is claimed is:

1. A liquid transport apparatus comprising:

a flow passage unit which has a liquid flow passage; and a transport force-applying mechanism which applies a transport force to a liquid contained in the liquid flow passage, wherein:

the flow passage unit includes a plurality of stacked plates which are formed with a plurality of flow passage-forming holes respectively for constructing at least a part of the liquid flow passage;

mainstream areas and branch areas are formed in the plurality of flow passage-forming holes respectively, the mainstream areas being substantially overlapped with each other as viewed in a direction perpendicular to the plates, and the branch areas being disposed outwardly as compared with the mainstream areas as viewed in the direction perpendicular to the plates; and the branch areas are provided so that adjacent branch areas, which are adjacent to each other in a stacking direction of the plates, are partially overlapped with each other as viewed in the direction perpendicular to the plates, and the branch areas are formed in a spiral form.

2. The liquid transport apparatus according to claim 1, wherein a plurality of the branch areas are formed in one of the flow passage-forming holes.

3. The liquid transport apparatus according to claim 2, wherein the branch areas, which are formed in one of the flow passage-forming holes, are arranged at equal angular intervals in a circumferential direction to depict the spiral form.

4. The liquid transport apparatus according to claim 1, wherein the mainstream areas and the branch areas are connected to one another in the respective flow passage-forming holes.

5. The liquid transport apparatus according to claim 4, wherein the flow passage-forming holes are formed to have an elliptical shape which is long in a certain direction.

6. The liquid transport apparatus according to claim 1, wherein center lines of the mainstream areas are coincident with each other.

7. The liquid transport apparatus according to claim 1, wherein the branch areas are positioned while being deviated from each other by equal angles in a circumferential direction to depict the spiral form between adjoining plates.

8. The liquid transport apparatus according to claim 1, wherein:

the liquid flow passage includes a nozzle which discharges the liquid to outside of the flow passage unit; and the plurality of flow passage-forming holes define the liquid flow passage in the vicinity of the nozzle.

9. The liquid transport apparatus according to claim 1, wherein the transport force-applying mechanism is an actuator unit.

10. The liquid transport apparatus according to claim 1, wherein a mainstream of the liquid flows through the mainstream areas, and a branch of the liquid flows through the branch areas in the liquid flow passage.

11. A liquid transport apparatus comprising:

a flow passage unit which includes a stack formed by stacking a plurality of plates formed with through-holes respectively so that the through-holes are arranged on a predetermined axis to define a flow passage and which has a liquid discharge port communicated with the flow passage; and a transport force-applying mechanism which applies a transport force to a liquid contained in the flow passage, wherein:

outermost portions of walls for defining the through-holes of the plurality of plates, which are disposed farthest from the axis, are arranged so that a spiral is depicted about a center of the axis by the outermost portions as positions of the outermost portions approach the liquid discharge port, and the through-holes, which are formed through the plurality of plates, are elliptical respectively, centers of ellipses are positioned on the axis, and angles of rotation of the ellipses with respect to the axis differ among the plurality of plates.

12. The liquid transport apparatus according to claim 11, wherein the through-hole includes a plurality of holes.

* * * * *